United States Patent [19]

Grébert et al.

[11] 3,986,908

[45] Oct. 19, 1976

[54] COMPOSITE PROPELLANTS WITH A CELLULOSE ACETATE BINDER

[75] Inventors: Robert O. Grébert; Jacques Picard; Jean L. Tranchant, all of Saint-Medard-en-Jalles, France

[73] Assignee: Societe Nationale des Poudres et Explosifs, France

[22] Filed: June 25, 1973

[21] Appl. No.: 373,118

[30] Foreign Application Priority Data

July 5, 1972 France ..... 72.24226

[52] U.S. Cl. ..... 149/19.7; 149/19.2; 149/20; 149/83

[51] Int. Cl.[2] ..... C06B 45/10

[58] Field of Search ..... 149/19.2, 2, 19.7, 83, 149/44, 113, 20

[56] References Cited

UNITED STATES PATENTS

| | | | |
|---|---|---|---|
| 3,020,180 | 2/1962 | Morello | 149/19.7 |
| 3,126,304 | 3/1964 | Penner et al. | 149/19.7 |
| 3,161,550 | 12/1964 | Mosher et al. | 149/19.7 |
| 3,197,349 | 7/1965 | Kuhn et al. | 149/19.2 |
| 3,453,156 | 7/1969 | Hackett et al. | 149/19.2 |
| 3,663,036 | 5/1972 | Johnson | 280/150 AB |
| 3,665,862 | 5/1972 | Lane | 149/19.2 X |
| 3,692,495 | 9/1972 | Schneiter et al. | 280/150 AB X |
| 3,723,205 | 3/1973 | Scheffee | 149/19.91 |
| 3,773,351 | 11/1973 | Catanzarite | 102/39 X |
| 3,833,432 | 9/1974 | Moy et al. | 149/19.3 |

*Primary Examiner*—Edward A. Miller
*Attorney, Agent, or Firm*—Bucknam and Archer

[57] ABSTRACT

A composite propellant comprises, by weight:

a. from 78 to 92% of an oxidizing agent which is at least one of alkali metal, alkaline earth metal and ammonium chlorates and perchlorates, b. from 7.9 to 17.2% of an organic binder which contains oxygen but not nitrogen, and c. from 0.1 to 0.8% of a carbon-containing combustion regulator.

This composite propellant is useful as a gas generator for inflatable cushion protection devices because the gaseous combustion products are substantially free from toxic gases.

2 Claims, No Drawings

COMPOSITE PROPELLANTS WITH A CELLULOSE ACETATE BINDER

This invention is concerned with composite propellants, that is explosives comprising a solid oxidising agent and an organic binder which both acts as a fuel and gives adequate mechanical strength to the mixture. Composite propellants may contain a number of optional ingredients, such as combustion regulators and combustion accelerators, the latter usually being metals, such as aluminium.

Conventional composite propellants usually contain about 25% by weight of binder, and the charges are shaped solely by casting them in moulds. However, when the proportion of binder is substantially reduced, the viscosity of the mixture obtained on mixing the various constituents of the composite propellant increases and the mechanical properties of the charges produced are inferior and many charges show cohesion defects.

Moreover, the use of conventional composite propellants as gas generators in inflatable cushion protection devices for high speed vehicles, such as automobiles, cannot be considered because these propellants do not fulfil the condition that the gases they produce should be non-toxic, and because they possess poor mechanical properties which make it impossible to produce charges of small thickness. These disadvantages apply especially to composite propellants which have, as the main constituents, an oxidising agent of the metal perchlorate or chlorate type, a binder which contains oxygen but not nitrogen, and a rather ineffective inert combustion regulator.

The composition of the combustion gases of a known solvent-free powder (not of the composite type), which is at present commonly used as a gas generator, is given below:

| Composition of the combustion gases | |
|---|---|
| Main constituents: | |
| $CO_2$ | 10.8 mols/kg |
| $N_2$ | 4.84 mols/kg |
| $H_2O$ | 4.11 mols/kg |
| $H_2$ | 7.78 mols/kg |
| CO | 8.75 mols/kg, corresponding to 24.5% by weight. |

The combustion products also contain other gases in small proportions and solid residues. These products are produced by the combustion of a solvent-free powder composition comprising:

| | |
|---|---|
| Nitrocellulose (nitrogen content 11.7%) | 55.8 parts by weight |
| Nitroglycerine | 37.2 parts |
| Various ballistic additives | 7.5 parts |

The reaction takes place at a pressure of 200 bars and a temperature of about 2,640° K. The addition of additives, such as copper oxide, potassium dichromate and manganese dioxide, to such solvent-free powder compositions does not enable the carbon monoxide content to be reduced to below 8% by weight and, physiologically, a carbon monoxide content greater than 0.05% is dangerous. Restriction of the nitrogen oxide content is even more necessary and the total of these oxides must not exceed a few parts per million (ppm).

We have now developed composite propellant compositions which have good mechanical strength and which yield combustion gases which are substantially free of toxic gases and which are, therefore, suitable for use as gas generators for inflatable cushion protection devices.

According to the present invention, there is provided a composite propellant which comprises:

a. from 78 to 92% by weight of an oxidising agent which is an alkali metal, alkaline earth metal or ammonium chlorate or perchlorate or a mixture of two or more thereof, b. from 7.9 to 17.2% by weight of an organic binder which contains oxygen but not nitrogen, c. from 0.1 to 0.8% by weight of a carbon-containing combustion regulator and, optionally, a second combustion regulator, d. optionally, up to 5% by weight of a metal combustion accelerator, and e. optionally, up to 4% by weight of a plasticiser.

The preferred oxidising agent is potassium perchlorate, used alone or together with up to 6% by weight of ammonium perchlorate; other preferred oxidising agents are sodium perchlorate and potassium and/or sodium chlorates, individually or as mixtures.

The preferred binders are cellulose acetates, particularly cellulose triacetate, and silicone rubbers, particularly silicone rubbers with a carbon content less than 33%. The preferred proportion of cellulose triacetate is from 8 to 17.2% by weight, and that of silicone rubber is from 8 to 14.6% by weight. Below 8% by weight, the binder does not coat the grains of oxidising agent perfectly. The upper limit for the proportion of binder is determined by the necessity of obtaining a carbon monoxide content of not more than about 500 ppm on combustion.

Suitable carbon-containing combustion regulators are, for example, acetylene black and graphite. The preferred proportion of carbon-containing combustion regulator is 0.15 to 0.5% by weight. The second combustion regulator which may optionally be present is preferably copper dichromite in a proportion of from 0.5 to 5% by weight.

The preferred combustion accelerator is aluminium which preferably has a specific surface area of from 3400 to 3800 $cm^2$ per $cm^3$.

Many plasticisers may be employed, the preferred being tricresyl phosphate, diethyl phthalate and triacetin. The best results with respect to mechanical strength and toxicity of the gases produced, are obtained with triacetin which, for the same weight of plasticiser, introduces the least carbon into the composition. The role of the plasticiser is to provide good homogenisation during the mixing of the composite powder, to improve the ease with which it can be manufactured and, for the same binder content, to improve the mechanical properties of the charges produced.

Preferred composite compositions according to the invention are as follows:

| Composition A | |
|---|---|
| Cellulose triacetate | 8.5 to 17 parts by weight |
| Potassium perchlorate | 80 to 92 parts |
| Plasticiser | 1 to 3 parts |
| Acetylene black (combustion regulator) | 0.15 to 0.5 part |
| Aluminium | 0.5 to 2 parts |

-continued

| Composition B | |
|---|---|
| Silicone resin with a carbon content less than 33% | 8.5 to 14 parts by weight |
| Catalyst for the resin | 0.8 to 1.5 parts |
| Potassium perchlorate | 80 to 92 parts |
| Acetylene black | 0.15 to 0.5 part |
| Aluminium | 0.5 to 2.5 parts |

In order that the invention may be more fully understood, the following Examples are given by way of illustration only.

EXAMPLE 1

| Composition of the composite propellant | |
|---|---|
| Cellulose triacetate (with an acetyl content of 65%) | 10 parts by weight |
| Potassium perchlorate (particle size of 16 $\mu$) | 88 parts |
| Triacetin (plasticiser) | 3 parts |
| Acetylene black (combustion regulator) | 0.2 part |
| Aluminium | 1 part |

Method of working

The triacetate granules were passed through a mill and introduced into a malaxator with 3 parts of the plasticiser and 50 parts of cyclohexanone as solvent.

A mixture of the potassium perchlorate, acetylene black and aluminium had been homogenised separately in a mixer, and this mixer was then introduced into the malaxator in three stages. Mixing in the malaxator was carried out for 2½ hours, and after the malaxator had been opened, the paste obtained, which tended to dry quite quickly, was immediately poured into and packed into moulds having the dimensions of the charges to be produced.

Satisfactory mechanical properties (impact resistance tests and vibration resistance tests) were obtained with the following particle sizes: 16$\mu$ for $KClO_4$ (material of one particle size only) or 20$\mu$ and 8$\mu$ (material consisting of mixture of two particle sizes) for $KClO_4$; 3$\mu$ for acetylene black; the aluminium had a specific surface area of between 3,400 and 3,800 $cm^2/cm^3$.

EXAMPLE 2

| Composition of the composite propellant | |
|---|---|
| Silicone resin RTV 121 (or RTV 502 or RTV 141) | 13 parts by weight |
| Catalyst for the resin | 1.3 parts |
| Potassium perchlorate (mixture of two particle sizes, 20$\mu$and 8$\mu$) | 87 parts (75 parts at 20$\mu$ and 12 parts at 8$\mu$) |
| Acetylene black | 0.3 part |
| Aluminium | 2 parts |

The silicone resins RTV 121, RTV 502 and RTV 141 are sold by RHONE POULENC and are silicone rubbers with a carbon content less than 33% by weight.

For example, the composition in % by weight of RTV 141 resin was as follows: C : 29.6; H : 8; O : 22.6; Si : 39.8.

Method of working

The oxidising agent and the additives were introduced into a mixer and, after being homogenised for two hours, were transferred to a malaxator in which the silicone resin had been dissolved in 50 parts of trichloroethylene. After malaxating for two hours, the catalyst was introduced and, since the viscosity increased very rapidly, moulding preferably by casting, had to be carried out during the following 15 minutes. Evaporation of all of the solvent took place in 24 hours at 20° C.

In order to obtain a carbon monoxide content of not more than about 0.05% in the combustion gases (under normal conditions of pressure and temperature), the amount of binder in the compositions was restricted to 17% in the case of cellulose triacetate and 14% in the case of the silicone resins.

Since the mechanical properties increase with the percentage of binder used, and as this percentage cannot, in any case, be less than 8%, it is of value to use a proportion of binder less than the preferred limiting proportions of 17% and 14% mentioned above and to use additives which improve the mechanical properties of the composite propellant powder. The aluminium present in the compositions examplified above improves the mechanical strength of the composition, particularly the impact resistance and vibration resistance; its influence on the rate of combustion is also valuable when the composite propellant is used as a gas generator. The composition described in Example 1 but omitting the aluminium burns at a pressure of 70 bars at 26 mm/second, while the same composition containing the maximum percentage of aluminium, 5%, burns at 44 mm/second. The maximum aluminium content is determined by the rise in the reaction temperature due to the exothermic properties of aluminium and which, in turn, leads to an increase in the carbon monoxide content of the combustion gases as is shown in the following table:

| Proportion of triacetate | CO at the neck of the pipe (ppm) | | | |
|---|---|---|---|---|
| | 0% Al | 2% Al | 3% Al | 4% Al |
| 8 | | 9 | 32.2 | 80 |
| 10 | | 42 | 103 | 261 |
| 12 | 17 | 126 | 288 | 514 |
| 14 | 75 | 317 | 600 | 1,020 |
| 16 | 210 | 690 | 1,360 | 3,450 |
| 18 | 700 | 1,635 | | |

Since gas generators used in inflatable cushion protection devices for high speed vehicles must liberate all of their combustion products within periods of time which are generally less than 20 milliseconds, the rates of combustion needed dictate the use of charges of low thickness. It has been found that the rate of combustion varies greatly as a function of the thickness of the wall of the charge. For a composition based on silicone resin (Example 2), the rate of combustion of 36 mm/second which can be observed on a block of substantial thickness can be increased to 50 mm/second and even higher with low thicknesses. This increase in the rate is due, in particular, to heat exchange by radiation between the two opposite walls, but in the case of a translucent propellant, this phenomenon is accompanied by local variations in the rate of combustion which manifest themselves by an unevenness in combustion which disturbs the properties of the gas generator, and blisters and craters appear on the combustion surface. Carbon-containing combustion regulators, and especially acetylene black, make it possible to overcome these disadvantages. A suitable percentage of one of these carbon-containing combustion regulators, such as those indicated in the Examples, leads to a higher rate of combustion being maintained for charges of low thickness, whilst reducing the unevenness in combustion and hardly increasing the production of carbon monoxide at all. We have found that combustion regulators which do not contain carbon, such as talc or chalk, have no effect on charges of low thickness and that combustion regulators of the metal salt type, such as copper dichromate, had to be used in large proportions, which could be as much as 9%, and that such a content was prejudicial to the mechanical properties of the charge since it was necessary to use a low content of binder so as not to increase the production of carbon monoxide. We have found, moreover, that by limiting the combustion temperature by adding aluminium in an amount of not more than 5%, it is possible to use carbon-containing combustion regulators whilst being able to keep the carbon monoxide content below 500 ppm.

It should be noted that the compositions with a low binder content which can be used as gas generators have the characteristic that the rate of combustion as a function of pressure is substantially linear and parallel for temperatures of 60°, +20° and −30° C.

When used as a gas generator, the composition of Example 2 has a potential of 1,468 cal/g and burns at a temperature of 2,184° C under a pressure of 70 bars. The solid residues correspond to 43% of the original mass and, under normal conditions of temperature and pressure, 0.307 litre of gas per gram of propellant is obtained, corresponding to 13.7 mols/kg. These gases have the following composition under the conditions of use in inflatable cushions (1 bar, 100° C):

$H_2O = 44\%$
$CO_2 = 28\%$
$O_2 = 28\%$
$CO \approx 0.05\%$

When used as a gas generator, the composition of Example 1 has a potential of about 1,400 cal/g and burns at a temperature of 1,730° C under a pressure of 70 bars. The solid residues correspond to 6.75% of the original mass and, under normal conditions of temperature and pressure, 0.357 liter of gas per gram of powder is obtained, corresponding to 16 mols/kg. These gases have the following composition under the conditions of use in inflatable cushions.

$H_2O = 20.6\%$ $CO_2 = 31.2\%$ $O_2 = 48.2\%$ $CO \leq 0.05\%$

What is claimed is:

1. A composite propellant, which consists essentially of, by weight:

a. about 80 to about 92 parts of potassium perchlorate,
b. about 8.5 to about 17 parts of cellulose triacetate,
c. about 0.15 to about 0.5 parts of acetylene black,
d. about 0.5 to about 2 parts of aluminium powder, and
e. about 1 to about 3 parts of a plasticiser, the ingredients being in such amounts that said propellant produces combustion gases free of nitrogen oxides and containing less than 0.05% of carbon monoxide.

2. A composite propellant as set forth in claim 1, which consists essentially of, by weight:

a. about 88 parts of potassium perchlorate with a particle size of about 16 microns,
b. about 10 parts of cellulose triacetate,
c. about 0.2 parts of acetylene black,
d. about 1 part of aluminium powder, and
e. about 2.5 parts of triacetin.

* * * * *